United States Patent [19]

Martin

[11] 3,959,177

[45] May 25, 1976

[54] MULTIFUNCTIONAL CORROSION INHIBITORS

[75] Inventor: Richard L. Martin, St. Louis, Mo.

[73] Assignee: Petrolite Corporation, St. Louis, Mo.

[22] Filed: Dec. 7, 1973

[21] Appl. No.: 422,750

[52] U.S. Cl. ..... 252/389 A; 21/2.5 A; 21/2.7 A; 252/391; 252/395

[51] Int. Cl.[2] ..... C23F 11/16

[58] Field of Search ..... 252/389 A, 391, 395; 21/2.5 A, 2.7 A; 260/327 R

[56] References Cited

UNITED STATES PATENTS 3,238,132 3/1966 Cyba ..... 252/389 A 3,376,225 4/1968 Anderson ..... 252/391

*Primary Examiner*—Leland A. Sebastian
*Assistant Examiner*—Irwin Gluck
*Attorney, Agent, or Firm*—Sidney B. Ring; Hyman F. Glass

[57] ABSTRACT

This invention relates to corrosion inhibitors which are not only effective against metal loss corrosion but are also effective against corrosion of the cracking type such as (1) stress (continuing tensile stress) cracking, (2) hydrogen embrittlement or blistering, and (3) corrosion fatigue (alternating tensile stress).

8 Claims, No Drawings

MULTIFUNCTIONAL CORROSION INHIBITORS

Stress corrosion cracking has been defined as failure by cracking due to the combined action of corrosive material and stress, the stress being either external (applied) or internal (residual). Generally the cracking may be either intergranular or transgranular, depending upon the stressed metal and the corrosive material.

Not all metals susceptible to stress corrosion cracking are uniformly affected by any particular corrodant. For example, carbon steels are most susceptible to stress corrosion cracking in nitrate environments, and copper alloys are most affected by ammonia, while austenitic stainless steels are most susceptible to stress corrosion cracking in chloride environments.

One of the most troublesome areas of stress corrosion cracking has been that of austenitic stainless steels in contact with chloride environments. Some chloride solutions, such as alkaline or alkaline-earth chlorides, are so aggressive when heated that they will cause highly stressed austenitic stainless steels to crack in extremely short periods of time, which may be less than about 30 minutes. Extensively cold-worked or as-drawn parts are especially susceptible because of the high degree of internal stresses. However, even annealed parts will fail in relative short periods of time under extreme conditions and external stresses. On the other hand, completely unstressed austenitic stainless steel would be excellent for use in contact with chloride solutions because of its resistance to ordinary corrosion effects.

The ferritic and martensitic stainless steels are also subject to stress corrosion cracking to a more limited extent. However, the problem is not so serious with these stainless steels because the martensitic stainless steels are quite uncommon, and the ferritic stainless steels cannot be used in chloride environments because they will be badly pitted and corroded.

Since the mechanism of stress corrosion cracking has not yet been established, the prior art has shown very little that can be done to prevent it. Some techniques have been developed, although they are not highly successful or desirable.

Another type of stress corrosion cracking which occurs is due to the presence of hydrogen which is also called hydrogen embrittlement. This type of corrosion is due to hydrogen given off in the corrosion process and is generally aggravated by the presence of $H_2S$.

Hydrogen embrittlement of steel occurs when free hydrogen atoms adsorbed on the metal surface diffuse into the metal by intercrystalline or interstitial diffusion. Once in the steel the hydrogen may remain in atomic form or, upon reaching an interstitial void of larger than atomic dimensions, may combine to form internal pockets of hydrogen gas. Hydrogen is found to permeate preferentially in stressed regions and to enter the voids nearest the stressed regions.

The diffusion of hydrogen into the steel is accompanied by the formation of internal gas pockets, initiation and promotion of cracks in high stress areas, and certain other phenomena which induce the condition characterized by delayed brittle failure of the steel and by reduced ability of the steel to support sustained loads.

Hydrogen embrittlement is induced in steel in a number of ways including for example, acid pickling, cathodic cleaning, electroplating, electrochemical machining, heating in moist atmospheres, exposure to moisture under corrosive conditions and exposure to hydrogen at elevated temperature and pressures.

Embrittlement of steels is known to occur in bodycentered cubic microstructures such as exist in tempered martensite, bainite, lamellar pearlite and spheroidized structures, but fully austenitic steels are found to be quite resistant to such embrittlement. In general, higher strength steels, i.e., above abour 200,000 p.s.i. ultimate tensile strength, are more susceptible to this type of failure although embrittlement has been found in steels having strength levels of 60,000 p.s.i. or lower. The composition of the steel it not an important factor in hydrogen embrittlement, and no alloying element either substitutional or interstitial has been truly effective in retarding hydrogen induced delayed brittle failure.

In low tensile strength steels hydrogen absorbed in this way more frequently causes blisters rather than cracking failure.

Still another type of corrosion is corrosion fatigue which is a process of failure of alloys where alternating tensile stresses rather than continuing tensile stresses, as occurs in stress corrosion cracking, are involved along with corrosion. There is a relationship between corrosion fatigue and stress corrosion cracking in many systems. In non-corrosion fatigue, failure starts with crack initiation at a stress riser followed by propagation due to mechanicalmetallurgical forces until the member fails. This propagation can occupy 90% of the specimen life. Corrosion hastens the process by causing stress rising pits to form on the surface and by causing either direct metal loss or metal weakening at the notch of the propagating crach by a stress corrosion cracking mechanism. Thus, a corrosion inhibitor effective against corrosion fatigue is both a good metal loss inhibitor as well as a good stress corrosion inhibitor.

In contrast to stress corrosion cracking, the conventional corrosion inhibitor inhibits corrosion due to metal loss by attack of the corrodant on the metal per se.

I have now discovered inhibitors which are not only effective against metal loss corrosion but are also effective against 1. Stress (continuing tensile stress) cracking,
2. Hydrogen embrittlement or blistering, and
3. corrosion fatigue (alternating tensile stress) in metals such as in alloys of the transition metals.

The corrosion inhibitors employed in this invention comprise the following type:

1. The film-forming type as exemplified by acylated polyamines which yield amides and cyclic amidines such as imidazolenes and tetrahydropyrimidines. These are primarily effective in inhibiting metal loss corrosion. (Film-formers)

2. The phosphorus-sulfur-containing type which are exemplified by thiophosphates, pyrophosphates containing both oxygen and sulfur, and particularly mixtures thereof. (Thiophosphates)

3. Sulfur compounds as exemplified by 1,2-dithole-3-thione and quaternaries thereof, i.e., the 1,2-dithiolum compounds. (Trithiones)

The compositions of (2) and (3) above are effective against corrosion of the cracking type as contrasted to corrosion of the metal loss type. In some systems (2) and/or (3) above serve both functions, that is they are optimum metal loss inhibitors as well as cracking type inhibitors.

The weight ratio of thiophosphates to trithiones is about 1:0 to 0:1, such as from about 10:1 to 1:10, for example from about 4:1 to 1:4, but preferably from about 2:1 to 1:2.

Where the film-former is employed, of thiophosphates to trithiones to film-former the weight ratio is about 10:0:1 to 0:10:10, e.g., about 10:0:1 to 0:10:1 to 1:0:10 to 0:1:10, for example from about 5:0:1 to 0:5:5, e.g., about 5:0:1 to 0:5:1, to 1:0:5 to 0:1:5, such as from 3:0:1 to 0:3:3, e.g., from about 3:0:1 to 0:3:1 to 1:0:3 to 0:1:3, but preferably from about 2:0:1 to 0:2:2, e.g., about 2:0:1 to 0:2:1 to 1:0:2 to 0:1:2.

In general, film-forming organic corrosion inhibitors are generally heteropolar, for example, cationic or anionic in nature. The most widely used type of film-forming corrosion inhibitor is the cationic type, which is generally a comparatively high molar organic compound containing one or more basic nitrogen atoms.

Anionic film-forming inhibitors contain hydrophobic groups, which have generally large hydrocarbon radicals, and acid groups. In general, they are used as the free acid or as salts thereof, for example as alkali or alkaline earth metal, ammonium or amine, etc., salts, for example as the sodium, potassium, calcium, ammonia, amine, etc. salts.

In general, assuming a monomolecular layer, the more effective film-forming corrosion inhibitors are those which cover the largest area per molecule and form the most coherent and oriented film.

Typical, but non-limiting examples, of film-forming corrosion inhibitors are presented below.

Nitrogen Bases

A wide variety of these compounds are known to be film-forming corrosion inhibitors. The following are a few non-limiting examples: 1. Oxazolines (U.S. Pat. No. 2,587,855) 2. Tetrahydropyrimides (U.S. Pat. No. 2,640,029) 3. Imidazolines (Re. 23,227) 4. Pyrrolinediones (U.S. Pat. No. 2,466,530) 5. Amino amides (U.S. Pat. No. 2,550,582 and 2,598,213) 6. Quaternary amines (U.S. Pat. No. 2,659,693) 7. Monoamines, such as Rosin Amine (OIL GAS JOURNAL 46, No. 31, 91-6 (1946)) Oxyalkylated Rosin Amine (U.S. Pat. No. 2,564,740) Rosin Amine + solubilizing agent (U.S. Pat. Nos. 2,564,757 and 2,564,753).

Amides of amino acids such as the sarcosines for example

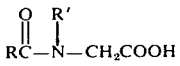

R = fatty hydrocarbon group

R′ = H, lower alkyl

The imidazolines are a member of the cyclic amidine family of compounds and are prepared in the manner described in Reissue 23,227, U.S. Pat. No. 2,468,163, and elsewhere.

They may be described, for example, as follows:

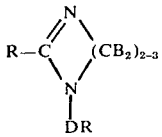

(1)

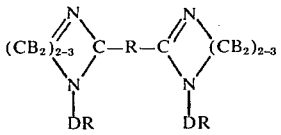

(2)

where

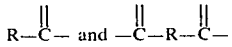

are residues derived from the carboxylic acid employed in preparing the compound wherein R is, for example, a hydrocarbon radical, having, for example, up to about 30 carbon atoms, such as 1–30 carbon atoms, B is hydrogen or a hydrocarbon radical, for example, a lower alkyl, such as methyl - for example, where $CB_2$ is

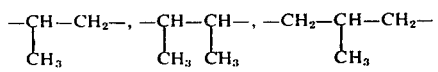

but preferably — $CH_2$ — $CH_2$ — or — $CH_2$ — $CH_2$ — $CH_2$ - , and R is the residue derived from the cyclic amidine-forming polyamine, for example where DR is

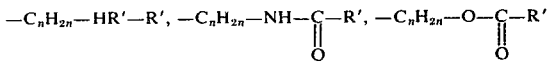

— $C_nH_{2n}$ — O — R′, — $C_nH_{2n}$ — NR′ — $C_nH_{2n}$ — NR′ — R′ — $C_nH_{2n}$ — HR′ — $C_nH_{2n}$ — NR′ — $C_nH_{2n}$ — HR′ — R′

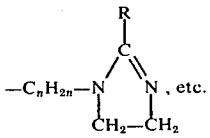

and wherein n is, for example, the numeral 1 to 6 and R′ is hydrogen or an aliphatic, cycloaliphatic hydrocarbon, etc., radical.

In the simplest case, the group R′ may be directly attached to the 1-nitrogen atom of the ring, as follows:

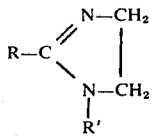

The particularly outstanding corrosion-preventive reagents result when the cyclic amidine contains basic nitrogen groups in addition to those inherently present in the imidazoline ring. In general, compounds of this type which are effective are those in which the basic nigrogen group is contained in the radical D in the above formula.

In this case the products may be represented by the formula

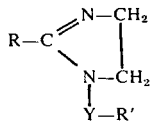

where R and R′ are hydrogen or a hydrocarbon radical, and in which at least one of the groups R and R′ is an aliphatic or cycloaliphatic hydrocarbon group containing from 8 to 32 carbon atoms; and Y is a divalent organic radical containing amino groups. The group R′ may be, and usually is, an amino nitrogen substituent. Examples or organic radicals which Y - R′ may represent are $-C_2H_4-NR', -C_2H_4-NR'-C_2H_4-NR_2', -C_3H_6-NR_2'$

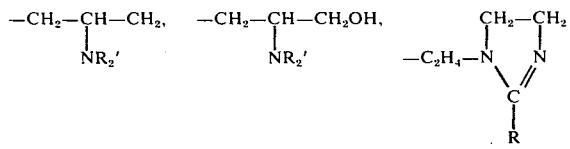

$-C_2H_4 - NR - C_2H_4 - NR' - C_2H_4 - NR_2'$ where R′ and R have their previous significance.

Of this class of reagents in which an amino group occurs as a portion of the 1-nitrogen substituent, those which are derived, at least theoretically, from the polyethylene polyamines appear to be particularly effective as corrosion inhibitors. These have the general formula:

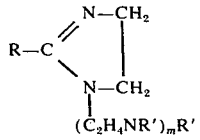

where R and R′ have their previous meanings, and m is a small number, usually less than 6. Amides of these imidazolines are also effective.

Imidazolines have been described in Re. No. 23,227. A typical claim is as follows:

"A process for preventing corrosion of metals comprising the step of applying to such metals a substituted imidazoline selected from the class consisting of

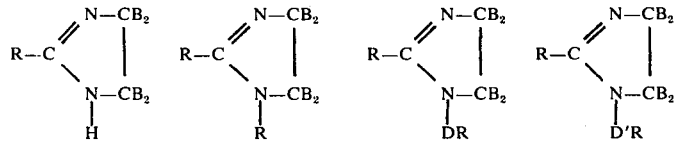

in which D represents a divalent, non-amino organic radical containing less than 25 carbon atoms, composed of elements from the group consisting of C, H, O, and N; D′ represents a divalent, organic radical containing less than 25 carbon atoms, composed of elements from the group consisting of C, H, O and N; D′ represents a divalent organic radical constining less than 25 carbon atoms, composed of elements from the group consisting of C, H, O and N, and containing at least one amino group; R is a member of the class consisting of hydrogen and aliphatic and cycloaliphatic hydrocarbon radicals; with the proviso that at least one occurrence of R contains 8 to 32 carbon atoms; and B is a member of the class consisting of hydrogen and alkyl radicals having not over 2 carbon atoms, with the proviso that at least three occurrences of B be hydrogen."

Tetrahydropyrimidines have been described in U.S. Pat. No. 2,640,028 where a typical claim is as follows:

"A process for preventing corrosion of metals including the step of applying to such metals a substituted tetrahydropyrimidine of the formula type:

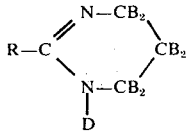

where D is a member of the class consisting of D′ — R and R′D′ represents a divalent organic radical containing less than 25 carbon atoms, composed of elements from the group consisting of C, H, O and N; R is a member of the class consisting of hydrogen and hydrocarbon radicals, with the proviso that at least one occurrence of R contains from 8 to 32 carbon atoms; B is a member of the class consisting of hydrogen and hydrocarbon radicals containing less than 7 carbon atoms, with the proviso that at least three occurrences of B be hydrogen."

In general, the preferred embodiments of film-forming corrosion inhibitors are of the type of cyclic amidines described above and acylated alkylene polyamines of the type described in U.S. Pat. No. 2,598,213 which are by reference incorporated in the present application.

The above cyclic amidines often contain amidoamines mixed in the reaction products. Thus, the term acylated polyamines includes both amidoamines and cyclic amidines.

Mixtures of thiophosphates, pyrophosphates containing both oxygen and sulfur, and oxygen phosphates are effective as corrosion inhibitors particularly in aqueous and/or oxygenated systems. The mixtures are synergistically more effective as corrosion inhibitors than each component individually.

Although the reaction of simple alcohols with $P_2S_5$ primarily proceeds according to the following equation $$4ROH + P_2S_5 \rightarrow 2(RO)_2\overset{\overset{S}{\|}}{P}SH + H_2S\ ,$$

when certain alcohols are reacted, for example higher alkyl alcohols, phenols, oxyalkylated alcohols, etc., side reactions predominate. Thus,

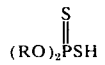

initially formed from such alcohols yields, through anhydride formation and/or isomerization, pyrophosphates as illustrated in the following equations:

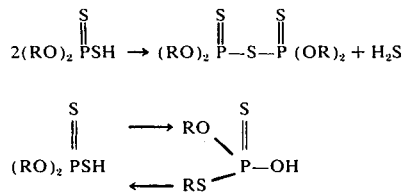

Although the ratio of products will vary with reactants, properties, reaction conditions, etc., a typical reaction product ratio of products formed by reacting an oxyalkylated alcohol with $P_2S_5$ is as follows:

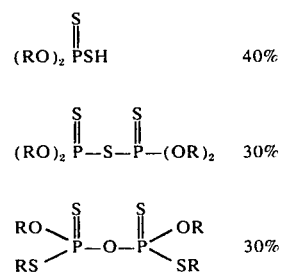

Thus, the major part of the product comprises anhydrides and/or isomerized anhydrides (i.e., pyrophosphates) which are excellent corrosion inhibitors, etc.

The production of pyrophosphates which contain both sulfur and oxygen of the formula

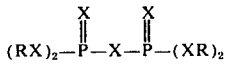

where X = O or S in substantial amounts is unexpected since the reaction of simple alcohols, such as lower alkyl alcohols ROH, with $P_2S_5$ yields little, if any, pyrophosphates. See Houben-Weyl, Phosphorus Compounds, Part II, p. 684, published by Georg Thieme Verlag in 1964. In contrast where the more complex alcohols are reacted, for example, oxyalkylated alcohols such as of the formula $R(OA)_nOH$ where R is alkyl, cycloalkyl, alkenyl, aryl, aralkyl, alkaryl, heterocyclic, etc., higher alkyl alcohols such as where R has at least seven carbon atoms, etc., pyrophosphates comprise a substantial part of the resultant reaction product. In general, the yield of pyrophosphate is increased by prolonged heating. Thus, in order to increase the yield of pyrophosphates, in contrast to reaction time of 1 – 3 hours for the dialkyl dithiophosphates, reaction times at elevated temperatures of more than 3 hours, such as 3 – 15 or more hours, enhance the yield of pyrophosphates. The use of vacuum or reduced pressure during this heating period also enhances the yield of pyrophosphates, e.g., 20 mm – 150 mm.

The general procedure for reacting alcohols with $P_2S_5$ to form dithiophosphoric acids is to continue reaction until most of the $P_2S_5$ has dissolved and the evolution of $H_2S$ has subsided. In contrast, the general procedure for preparing the pyrophosphates is to continue the reaction past this point so as to shift the equilibrium in favor of converting the dithiophosphoric acids to the pyrophosphate.

Since the crude reaction products contain O,O—disubstituted dithiophosphoric acids

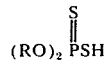

salts of these can also be prepared.

The salts are prepared by the simple neutralization of the acid with a suitable salt-forming base or by double decomposition. moiety salt miety may be for example, Cu, Ni, Al, Pb, Hg, Cd, Sn, Zn, Mg, Na, K, $NH_4$, amine, Co, Sr, Ba, etc. These may be prepared from the corresponding oxide, hydroxide, carbonate, sulfide, etc. An alternative to the preparation of salts is to use a simple combination of dithiophosphate with a metal salt such as zinc chloride, zinc sulfate, etc. This allows the use of higher stoichiometric amounts of metal ions to dithiophosphate, such as from 1:1 to 4:1.

The alcohols employed to prepare the ester may be oxyalkylated alcohols for example of the formula $$R(OA)_n\,OH$$

where OA is a moiety derived from an alkylene oxide and n is a number for example from about 1 – 100 or more, for example from 1 – 50, such as from 1 – 25, but preferably from 1 – 10.

The alkylene oxides employed herein are 1,2-alkylene oxides of the formula

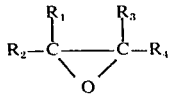

where $R_1$, $R_2$, $R_3$ and $R_4$ are selected by the group consisting of hydrogen, aliphatic, cycloaliphatic, aralkyl, etc. for example ethylene oxide, propylene oxide, butylene oxide, amylene oxide, octylene oxide, styrene oxide, methyl styrene oxide, cyclohexene oxide (where $R_1$ and $R_3$ are joined to make a ring), etc.

The alkylene oxide may be added to form homo polymer, stepwise to form block polymers, as mixtures to form heteropolymers or combinations thereof, etc.

For Example
$R(OEt)_nOH$,
$R(OPr)_nOH$,
$R(OEt)_n(OPr)_mOH$,
$R(OPr)_n(OEt)_mOH$,
$R(OEt\text{-}OPr)_nOH$, etc.
mixed These phosphates derived from $P_2S_5$ are designated in the following discussion as Type A. These materials are significantly improved as corrosion inhibitors and scale inhibitors by mixing with non-sulfur containing phosphates designated as Type B.

The Type B phosphates preferredly are formed by phosphorylation of the alcohols described above using reagents as phosphorus pentoxide, polyphosphoric acid, phosphorus oxychloride, etc.

Examples 1 – 5 illustrate the thiophosphate materials and Examples 6 – 14 the non-sulfur containing phosphate esters.

The reaction of alcohols with $P_2O_5$ is carried out in the conventional manner. It may be summarized by the following idealized equation

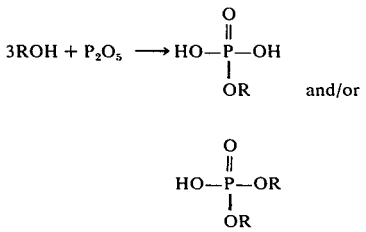

In general, the alcohols employed in preparing the oxygen phosphates are the same as that employed with the thiophosphates.

The following examples illustrate thiophosphate compounds: (Type A)

Example 1

The alcohol derived from the addition of 1 weight of ethylene oxide to "Alfol" 8 - 10 (576g; 2 mole) was stirred at 25 – 40° while $P_2S_5$ (111g; 0.5 mole) was added during 2 hours. The reaction was heated to 105° – 109° at a pressure of 70 mm for 9-½ hours. Upon cooling the product, 657g. was obtained as a pale yellow liquid. Sulfur analysis, 9.06%; phosphorus, 4.77%; acid value 0.62 meg/g. The product was neutralized with anhydrous ammonia.

Example 2

The alcohol derived from the addition of 1 weight of ethylene oxide to "Alfol" 8 – 10 (288g; 1 mole) was stirred at 70° – 75° C. while $P_2S_5$ (55g; 0.25 mole) was added in 60 mins. The reaction mixture was heated at 100° – 110° under reduced pressure (75mm) for 8 hours as $H_2S$ was evolved. The resulting acid was neutralized with dimethyl aniline.

Example 3

The alcohol derived from the addition of 2 weights of ethylene oxide to "Alfol" 8 - 10 (432g; 1 mole) was stirred at 70° – 75° C. during the addition of $P_2S_5$ (55g; 0.25 mole). The addition was complete in 60 min. and heating was continued at 100° – 110° for 10 hours to complete $H_2S$ evolution. Neutralization was effected by the addition of anhydrous ammonia.

The following examples use higher $P_2S_5$ ratios.

Example 4

The alcohol derived from the addition of 1 weight of ethylene oxide to "Alfol" 8 - 10 (288g; 1 mole) was heated at 75° – 80° C while $P_2S_5$ (70g; 0.315 mole) was added during 45 min. The mixture was heated at 100° – 105° C. for 3 hours at which time $H_2S$ evolution was complete. After cooling to 70° tributylamine (42g) was added and the mixture stirred at 70° – 75° for 1 hour to complete neutralization.

Example 5

The alcohol derived from the addition of 1 weight of ethylene oxide to "Alfol" 8 – 10 (288g; 1 mole) was heated at 75° –80° C. with stirring while $P_2S_5$ (70g; 0.315 mole) was added in 45 min. The mixture was heated at 100° – 110° for 4 hours to complete evolution of $H_2S$. After cooling to 65° C. anhydrous ammonia (5g) was added to effect neutralization.

The following examples illustrate non-sulfur containing phosphates (Type B).

Example 6

To the alcohol derived from the addition of 0.8 weight of ethylene oxide to "Alfol" 8 - 10 (180g; 0.7 mole) was carefully added phosphorus pentoxide (33g; 0.23 mole). The reaction mixture spontaneously rose to 90° upon this addition. The reaction was completed by heating at 125° C. for 1 hour to yield a straw colored liquid.

Example 7

To the alcohol derived from 2-ethylhexanol with 1 weight of ethylene oxide added (130g; 1 mole) was added phosphorus pentoxide (47g; 0.33 mole) during 10 mins. This addition resulted in an exotherm taking the temperature to 75°. The phosphorylation was completed by heating at 110°for 1 ½ hours yielding a pale yellow liquid.

Example 8

To the alcohol derived from the addition of 1 weight of ethylene oxide to "Alfol" 8 – 10 (130g; 0.45 mole) was added polyphosphoric acid (77g; 0.45 mole) in 15 mins. This addition resulted in a temperature increase to 70°. The reaction was then heated at 110°– 112°for 1 hour to complete the reaction. The product was a viscous amber liquid.

The following tables present additional illustrative examples:

| Example No. | Alcohol | Phosphorylating Reagent | Procedure |
|---|---|---|---|
| 9 | "Alfol" 8–10+1 weight EtO* | $P_2O_5$ | Example 6 |
| 10 | "Alfol" 14+0.5 weight EtO | $P_2O_5$ | Example 6 |
| 11 | "Alfol" 8–10+0.8 weight EtO | Polyphosphoric Acid | Example 8 |
| 12 | "Alfol" 14+0.5 weight EtO | Polyphosphoric Acid | Example 8 |
| 13 | "Alfol" 8–10 | $P_2O_5$ | Example 6 |
| 14 | 2-ethyl hexanol | $P_2O_5$ | Example 6 |

*EtO = Ethylene Oxide

"Alfol" - linear alcohols number indicates predominant carbon chain.

The weight ratio of thiophosphate and/or pyrophosphate to phosphate can vary widely for example from about 10:1 to 1:10, such as from about 5:1 to 1:5 for example from about 3:1 to 1:3, but preferably from about 2:1 to 1:2.

1,2-dithiole-3-thiones are known compounds prepared by a variety of methods. Examples of such compounds, and methods for their preparation, are disclosed in THE CHEMISTRY OF HETEROCYCLIC COMPOUNDS. "Multi-Sulfur and Sulfur and Oxygen Five-and Six-Membered Heterocycles,"PART 1, pages 237-386, by David S. Breslow et al, Interscience Publishers, 1966.

1,2-dithiole-3-thiones may be expressed by the formula:

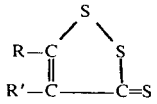

where R and R′ are substituted groups, for example, alkyl, aryl, cycloalkyl, alkenyl, alkynyl, alkaryl, aralkyl, heterocyclic, etc. In addition, one of the above R's may be hydrogen. Examples of a wide variety of 1,2-dithiole-3-thiones are presented in the above text by Breslow et al in Table 4, pages 352– 366, which is incorporated into this application as if part hereof.

1,2-dithiole-3-thiones are conveniently prepared by the classic method of reacting an olefin with sulfur, for example, according to the following equation:

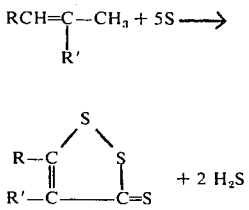

The olefin employed in the reaction contains 1. a reactive double bond
2. a primary carbon atom
3. at least four hydrogen atoms on the 3 terminal carbons with at least one hydrogen on the carbon beta to primary carbon atom.

This reaction is carried out at any suitable temperature and time, for example, at about 100°to 300°C., such as from about 140°to 240°C. but preferably from about 160°to 220°C. for a period of about 2 to 160 hours, and about 10 to 50 hours, but preferably about 15 to 40 hours.

The following examples are presented by way of illustration and not of limitation to show the preparation of 1,2-dithiole-3-thiones which may be employed as starting materials to prepare the dithiolium compounds of this invention.

Example 15

The Preparation of 4-phenyl-1,2-dithiole-3-thione

In a suitable reactor equipped with a stirrer, thermometer and a reflux condenser, was placed 118 g of methylstyrene and 48 g of sulfur. The mixture was heated for 37 hours at 200°–210°C. After the reaction was completed, the mixture was slowly cooled to room temperature. The product was collected and crystallized from benzene, red crystals, (32 grams, 50% yield), m.p. 112°–124°C.

Example 16

Preparation of 4-(3-methoxy-4-hydroxy)phenyl-1,2-dithiole-3-thione

In a suitable reactor equipped with a stirrer, thermometer, addition funnel and reflux condenser was placed, 32 g of sulfur, 1.0 g of di-o-tolylguanidine as catalyst and 150 cc of mesitylene as solvent. The mixture was brought to a reflux (170°C.) and over a 1 hour period 66 g of isoeugenol

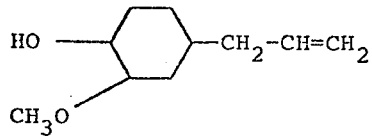

was added dropwise. Reflux was continued for 48 more hours. The mesitylene was decanted from the solid. The solid was treated twice with 500 cc portion of a 5% aqueous potassium hydroxide solution. Upon acidification the product precipitated as a brown solid.

Example 17

Preparation of 4-neopentyl-5-t-butyl-1,2-dithiole-3-thione

To a mixture of 320 g of sulfur and 6.0 g of di-o-tolylguanidine was added over a 9 hour period, at a reaction temperature of 210°–215°C., 336 g of triisobutylene, Mainly

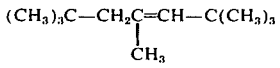

Heating at 210°–215°C. was continued for an additional 14 hours. The product was distilled and there was collected 220 g of 4-neopentyl-5-5-butyl-1,2-dithiole-3-thione, b.p. 155°–185°C. (3-4 mm Hg).

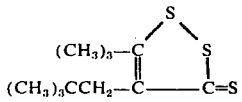

Example 18

Preparation of 4,5-tetramethylene-1,2-dithiole-3-thione

In a suitable reactor equipped with a stirrer, reflux condenser, thermometer and addition funnel was placed 24 g of sulfur, 171 g of carbon disulfide and 150 cc of dimethyl formamide. The mixture was cooled to 0°C. and under continuous stirring and cooling 132 g of 1-morpholino-1cyclohexene was introduced over a ½ hour period. After the addition was completed, stirring was continued for an additional 16 hrs. The resulting slurry was poured into water and the resulting orange solid crystallized from acetone, m.p. 95°–97°C. Yield 37%.

The following Table presents illustrative 1,2-dithiole-3-thiones of the formula

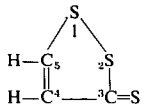

The radical indicated replaces the H's in the 4th and/or 5th positions as indicated.

TABLE I

| | |
|---|---|
| 1) | 4-$CH_3$ |
| 2) | 5-$CH_3$— |
| 3) | 4-$C_2H_5$— |
| 4) | 5-$C_2H_5$— |
| 5) | 4-$(CH_3)_3CCH_2$— |
| 6) | 5-n-$C_{17}H_{35}$— |
| 7) | 4-$C_6H_5$— |
| 8) | 5-$C_6H_5$— |
| 9) | 4-(p-$CH_3C_6H_4$—) |
| 10) | 5-(p-$CH_3C_6H_4$—) |
| 11) | 4-(p-$C_2H_5C_6H_4$—) |
| 12) | 4-(p-t-$C_4H_9C_6H_4$—) |
| 13) | 4-(p-t-$C_5H_{11}C_6H_4$—) |
| 14) | 5-(p-$C_6H_5$—$C_6H_4$—) |
| 15) | 5-(p-$ClC_6H_4$—) |
| 16) | 5-(p-$BrC_6H_4$—) |
| 17) | 5-(p-$IC_6H_4$—) |
| 18) | 4-(p-$CH_3OC_6H_4$—) |
| 19) | 5-(o-$CH_3OC_6H_4$—) |
| 20) | 5-(p-$CH_3OC_6H_4$—) |
| 21) | 5-(p-$HOC_6H_4$—) |
| 22) | 5-(p-$CH_3CO_2C_6H_4$—) |
| 23) | 5-[p-$(CH_3)_2NC_6H_4$—] |
| 24) | 5-[2,4-$(CH_3)_2C_6H_3$—] |
| 25) | 5-(2-$CH_3O$—5-$CH_3C_6H_3$—) |
| 26) | 5-[2,3-$(CH_3O)_2C_6H_3$—] |
| 27) | 5-[2,5-$(CH_3O)_2C_6H_3$—] |
| 28) | 5-[3,4-$(CH_3O)_2C_6H_3$—] |
| 29) | 5-(3-$CH_3O$—4-$HOC_6H_3$) |
| 30) | 5-(2-HO—3-$CH_3OC_6H_3$—) |
| 31) | 5-(3-$CH_3O$—4-$CH_3O_2CCH_2OC_6H_3$—) |
| 32) | 5-[3,4-$(HO)_2C_6H_3$—] |
| 33) | 5-[3,4-$(CH_3CO_2)_2C_6H_3$—] |
| 34) | 5-(3,4-Methylenedioxyphenyl-) |
| 35) | 5-(3,4,5-$I_3C_6H_2$—) |
| 36) | 4-(1-Naphthyl-) |
| 37) | 4-(1-Naphthyl-) |

38) 4-

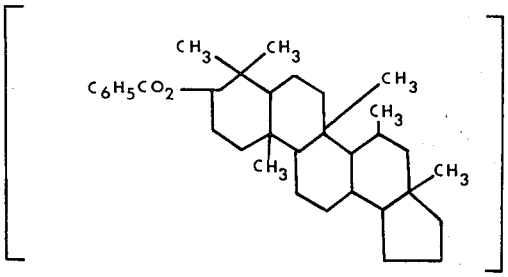

39) 4-

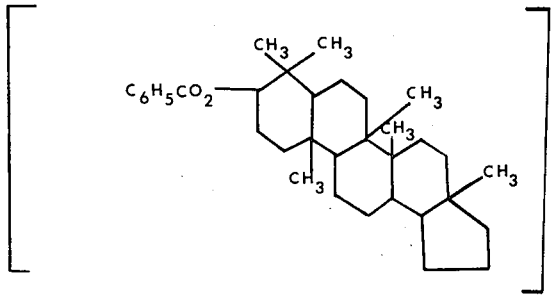

| | |
|---|---|
| 40) | 5-(2-Furyl-) |
| 41) | 4-(2-Thienyl-) |
| 42) | 5-(2-Thienyl-) |
| 43) | 4-(4-$CH_3$—2-thienyl-) |
| 44) | 5-(5-$CH_3$—2-thienyl-) |

TABLE I-continued

| | |
|---|---|
| 45) | 5-(5-$C_2H_5$—2-thienyl-) |
| 46) | 4-[3,4-$(CH_3)_2$—2-thienyl-] |
| 47) | 5-(2-Pyridyl-) |
| 48) | 5-(3-Pyridyl-) |
| 49) | 5-(4-Pyridyl-) |
| 50) | 5-($C_6H_5CH$=CH—) |
| 51) | 5-(p-$CH_3OC_6H_4CH$=C—) |
| 52) | 5-(2-Furyl-CH=CH—) |
| 53) | 5-[p-$(CH_3)_2HC_6H_4N$=CH—] |
| 54) | 5-[p-$(CH_3)_2NC_6H_4N$=CH—] |
| 55) | 5-$C_2H_5OOC$ |
| 56) | 5-HOOC— |
| 57) | 4,5-$(CH_3—)_2$ |
| 58) | 4-$CH_3$—5-$C_2H_5$— |
| 59) | 4-$C_2H_5$—5-$CH_3$— |
| 60) | 4,5-$(C_2H_5—)_2$ |
| 61) | 4-(n-$C_3H_7$—)-5-$CH_3$— |
| 62) | 4-(n-$C_4H_9$—)-5-$CH_3$— |
| 63) | 4-$CH_3$—5-(t-$C_4H_9$—) |
| 64) | 4-$(CH_3)_3CCH_2$—5-(t-$C_4H_9$—) |
| 65) | 4-[$(C_2H_5)_2NCH_2CH_2$—]-5-$CH_3$ . $HClO_4$ |
| 66) | 4-[$(C_2H_5)_2NCH_2CH_2$—]-5-$CH_3$ . HCl |
| 67) | 4-$C_6H_4CH_2$—5-$CH_3$— |
| 68) | 4-$CH_3$—5-$C_6H_5$— |
| 69) | 4-$C_6H_5$—5-$CH_3$— |
| 70) | 4-$C_2H_5$—5-$C_6H_5$— |
| 71) | 4-$CH_3$—5-(p-$CH_3C_6H_4$—) |
| 72) | 4-$CH_3$—5-(p-$ClC_6H_4$—) |
| 73) | 4-$CH_3$—5-(p-$BrC_6H_4$—) |
| 74) | 4-$CH_3$—5-(p-$IC_6H_4$—) |
| 75) | 4-$CH_3$—5-(o-$CH_3OC_6H_4$—) |
| 76) | 4-$CH_3$—5-(p-$CH_3OC_6H_4$—) |
| 77) | 4-(p-$CH_3OC_6H_4$—)-5-$CH_3$— |
| 78) | 4-$CH_3$—5-[2,4-$(CH_3)_2C_6H_3$—] |
| 79) | 4-$CH_3$—5-[2,5-$(CH_3)_2C_6H_3$—] |
| 80) | 4-$CH_3$—5-[3,4-$(CH_3)_2C_6H_3$—] |
| 81) | 4-$CH_3$—5-(4-$CH_3O$—3-$(CH_3C_6H_3$—) |
| 82) | 4-$CH_3$—5-(2$CH_3O$—4-$CH_3C_6H_3$—) |
| 83) | 4-$CH_3$—5-(2-$CH_3O$—5-$CH_3C_6H_3$—) |
| 84) | 4-$CH_3$—5-(2-$CH_3S$—5-CH $_3C_6H_3$—) |
| 85) | 4-$CH_3$—5-(2-HO—3-$CH_3OC_6H_3$—) |
| 86) | 4-$CH_3$—5-[2,4-$(CH_3O)_2C_6H_3$—] |
| 87) | 4-$CH_3$—5-[2,5-$(CH_3O)_2C_6H_3$—] |
| 88) | 4-$CH_3$—5-[3,4-$(CH_3O)_2C_6H_3$—] |
| 89) | 4-$CH_3$—5-[2,4,6-$(CH_3)_3C_6H_2$—] |
| 90) | 4-(1-Naphthyl-)-5-$CH_3$— |
| 91) | 4-(1-Naphthyl-)-5-$C_2H_5$— |
| 92) | 4-$CH_3$—5-(2-$CH_3O$—1-naphthyl—) |
| 93) | 4-$CH_3$—5-(2-thienyl—) |
| 94) | 4-(2-Thienyl-)-5-$CH_3$— |
| 95) | 4-(5-$CH_3$—2-thienyl-)-5-$CH_3$— |
| 96) | 4-$CH_3$—5-(5-$CH_3$—2-thienyl-) |
| 97) | 4-$C_2H_5$—5-(5-$CH_3$—2-thienyl-) |
| 98) | 4-(5-$C_2H_5$—2-thienyl-)-5-$CH_3$— |
| 99) | 4-$CH_3$—5-(5-$C_2H_5$—2-thienyl-) |
| 100) | 4-$C_2H_5$—5-(5-$C_2H_5$—2-thienyl-) |
| 101) | 4-$CH_3$—5-[4,5-$(CH_3)_2$—2-thienyl-] |
| 102) | 4-$CH_3$—5-(3-pyridyl-) |
| 103) | 4-$C_2H_5$—5-(3-pyridyl-) |
| 104) | 4-n-$C_4H_9$—5-(3-pyridyl-) |
| 105) | 4-$CH_3$—3-(4-pyridyl-) |
| 106) | 4-$C_2H_5$—5-(4-pyridyl-) |
| 107) | 4-$C_2H_5$—5-($C_6H_5CH$=CH—) |
| 108) | 4-$CH_3$—5-(p-$CH_3OC_6H_4CH$=CH—) |
| 109) | 4-$C_2H_5$—5-(p-$CH_3OC_6H_4CH$=CH—) |
| 110) | 4-(n-$C_3H_7$—)-5-(p-$CH_3OC_6H_4CH$=CH—) |
| 111) | 4-$C_2H_5$—5-(2-furyl-CH=CH—) |
| 112) | 4-(n-$C_3H_7$—)-5-(2-furyl-CH=CH—) |
| 113) | 4-$C_6H_5$—5-$C_6H_5CH_2$— |
| 114) | 4-($C_6H_5CO$—)-5-$C_6H_5$— |
| 115) | 4-($C_6H_5CS$—)-5-$C_6H_5$— |
| 116) | 4,5-$(C_6H_5—)_2$ |
| 117) | 4-(p-$CH_3OC_6H_4$—)-5-$C_6H_5$— |
| 118) | 4-(p-$HOC_6H_4$—)-5-$C_6H_5$— |
| 119) | 4-(p-$CH_3CO_2C_6H_4$—)-5-$C_6H_5$— |
| 120) | 4-$C_6H_5$—5-(2-$CH_3O$—5-$CH_3C_6H_3$—) |
| 121) | 4,5-(p-$CH_3OC_6H_4$—$)_2$ |
| 122) | 4-[2,4-$(CH_3O)_2C_6H_3$— -5-$C_6H_5$— ] |
| 123) | 4-(3-$HO_3S$—4-$CH_3OC_6H_3$—)-5-$C_6H_5$— |
| 124) | 4-(3-$ClO_2S$—4-$CH_3OC_6H_3$—)-5-$C_6H_5$— |
| 125) | 4-(3-$C_2H_5O_3S$—4-$CH_3OC_6H_3$—)-5-$C_6H_5$— |
| 126) | 4-(3-$C_6H_5NHO_2S$—4-$CH_3OC_6H_3$—)-5-$C_6H_5$— |
| 127) | 4-(3-$CH_3CO$—4-$CH_3OC_6H_3$—)-5-$C_6H_5$— |
| 128) | 4-(3-$C_2H_5CO$—4-$CH_3OC_6H_3$—)-5-$C_6H_5$— |
| 129) | 4-$C_6H_5$—5-(3-pyridyl-) |
| 130) | 4-$C_6H_5$—5-(4-pyridyl-) |
| 131) | 4-$C_6H_5$—5-(2-furyl-CH=CH—) |
| 132) | 4-$CH_3$—5-$CH_3O_2C$— |
| 133) | 4-$CH_3O_2C$—5-$C_6H_5$— |
| 134) | 4-$C_2H_5O_2$—5-$C_6H_5$— |
| 135) | 4-$C_6H_5$—5-$CH_3O_2C$— |
| 136) | 4-$CH_3$—5-[p-$(CH_3)_2NC_6H_4N$=CH—] |
| 137) | 4-$C_2H_5$—5-[p-$(CH_3)_2NC_6H_4$ N=CH—] |

TABLE I-continued

| | |
|---|---|
| 138) | 4-(n-$C_3H_7$—)-5-[p-$(CH_3)_2NC_6H_4N$=CH—] |
| 139) | 4-$C_6H_5$—5-[p-$(CH_3)_2NC_6H_4N$=CH—] |
| 140) | 4-$CH_3$—5-[p-$(CH_3)_2NC_6H_4N$=CH—] O |
| 141) | 4-$C_{2\ H5}$—5-[p-$(CH_3)_2NC_6H_4N$=CH—] O |
| 142) | 4-(n-$C_3H_7$—)-5-[p-$CH_3)_2NC_6H_4N$=CH—] O |
| 143) | 4-$C_6H_5$—5-[p-$(CH_3)_2NC_6H_4N$=CH—] O |
| 144) | 4-HS—5-$C_6H_5$— |
| 145) | 4-HS—5-(p-$CH_3OC_6H_4$—) |
| 146) | 4-$CH_3S$—5-$C_6H_5$— |
| 147) | 4-$CH_3S$—5-(p-$CH_3OC_6H_4$—) |
| 148) | 4-$CH_3COS$—5-$C_5H_5$— |
| 149) | 4-$CH_3COS$—5-(p-$CH_3OC_6H_4$—) |
| 150) | 4-$C_6H_5COS$—5-$C_6H_5$— |
| 151) | 4-$C_6H_5COS$—5-(p-$CH_3OC_6$ $H_4$—) |
| 152) | 4-$CH_3O$—5-$C_6H_5$— |

1,2-thiole-3-thiones can be converted to 1,2-dithiolium compounds by oxidizing 1,2-dithiole-3-thiones. Any convenient method of oxidation can be employed.

The preferred method of preparation depends on the particular thione to be oxidized. For example, where the thione yields an unstable dithiolium compound, it is desirable to precipitate the dithiolium salt from solution so that it does not decompose. This is done by precipitating the thiolium as an insoluble salt so it will not be decomposed by further oxidation. For example, aryl thiones when converted to the corresponding dithiolium compounds are unstable to further oxidation but their decomposition can be prevented by precipitation from solution during oxidation as insoluble salts.

Non-aryl substituted such as aliphatic dithiolethiones when converted to the corresponding dithiolium compounds yield stable compounds which are not subject to further oxidative decomposition. Therefore, it is not as important to precipitate such dithiolium compounds from solution as insoluble salts.

In general, the aliphatic dithiolium compounds are also more water soluble than the aryl dithiolium compounds. For example, certain aliphatic dithiolium compounds are at least 75% water soluble in contrast to the less than 10% solubility of the aryl dithiolium compounds. Thus aliphatic dithiolium compounds are not only more soluble but are also more stable than the aryl compounds.

Because of their high aqueous solubility and stability and aliphatic dithiolium compounds are particularly useful as corrosion inhibitors in aqueous and/or aerated and/or acidic systems.

A wide variety of oxidizing agents can be employed, as illustrated by the following:

1. aqueous solution of hydrogen peroxide
2. hydrogen peroxide and an organic or inorganic acid
3. barium permanganate
4. t-butyl-hydroperoxide
5. m-chloroperbenzoic acid
6. Caro's acid
7. peracetic acid
8. potassium persulfate
9. chromic anhydride
10. perchloric acid, etc.
11. other oxidation agents can also be employed.

The choice of oxidizing agent will depend on the particular thione to be oxidized, economics, etc.

In general, the thione is oxidized in a suitable solvent at as low a temperature consistent with a reasonable reaction time so as to minimize side reactions. The particular reaction time will depend on the particular thione, the particular oxidizing agent, etc.

In practice reaction times of from 0.5 hours to 24 or more hours are employed; with hydrogen peroxides shorter time can be employed such as from about 1 – 2 hours. With milder oxidizing agents such as organic peroxides longer times may be employed such as 24 hours with chloroperbenzoic acid.

Any solvent that does not interfere with the reactants and products can be employed for example; water, methanol, ethanol, 1-propanol, butanol, acetone, dimethyl sulfamide, dimethyl formamide, ether tetrahydrofuran, chloroform, carbon tetrachloride, etc.

In general, room temperature or lower is preferably employed to reduce side reactions. Higher temperatures may be employed in oxidizing certain thiones such as about 50°C. or higher in certain instances.

Although this invention is illustrated with the oxidation of thiones, dithiolium compounds can be prepared by other methods such as for example by those described in "Advances in Heterocyclic Chemistry" Katritzby, et al, Vol. 7, 1966, published by Academic Press, pp 39–151, which is incorporated herein as if part hereof.

The following Examples are presented by way of illustration and not of limitation.

EXAMPLE 19

3-t-Butyl-4-neopentyl-1,2-dithiolium hydrogen sulfate.

In a 2 liter four necked round-bottom flask equipped with a mechanical stirrer, a thermometer, a reflux condenser and an addition funnel was placed a mixture of 260 grams of 4-neopentyl-5-t-butyl 1,2-dithiole-3-thione and 500 cc of glacial acetic acid. The mixture was cooled to 15°C. and 258 grams of 30% hydrogen peroxide was added at such a rate that a reaction temperature of 15°–25°C. was maintained (2 hours). After the addition was completed, the mixture was stirred for an additional two hours at room temperature. The solvents were distilled off under diminished pressure. The remaining solid was washed with acetone and filtered to yield 258 grams (80% of theory) of 3-t -butyl-4-neopentyl 1,2-dithiolium hydrogen sulfate as a light yellow solid, m.p. 189-190°C; u.v. λ max. $H_2O$ (E) 254 mμ (5,000) and 306 mμ (6,800); nmr (solvent $D_2O$) τ in ppm, internal standard t.m.s., —0.03 (*s.*, 1H), 6.74 (*s.*, 2H), 8.22 (*s.*, 9H) and 8.88 (s., 9H).

Anal. Calced. for $C_{12}H_{22}O_4S_3$: C, 44.14; H,6.74; S,29.43 Found: C, 43.98; H,6.82; S,29.8

EXAMPLE 20

3-t-Butyl-4-neopentyl-1,2dithiolium perchlorate $HSO_4^- \rightarrow ClO_4^-$). To a solution of 5 grams of 3-t-butyl-4-neopentyl 1,2-dithiolium hydrogen sulfate in 5 grams of distilled water was added 4 cc of 70% perchloric acid. The white solid which precipitated was filtered and dried to yield 5 grams (100%) of material, m.p. 157°–158°C; u.v.λ max EtOH (E) 254 mμ (4,780) and 307 mμ (5,010).

Anal. Calced. for $C_{12}H_{21}S_2ClO_4$: S, 19.5 Found: S, 19.4

EXAMPLE 21

3-t-Butyl-4-neopentyl-1,2-dithiolium hydrogen sulfate.

The product was prepared in 80% of the theoretical yield according to a procedure identical as in Example 19, with the exception that instead of acetic acid as the solvent, a mixture of 50 g of acetic acid and 450 g of isopropanol as the solvent was employed.

EXAMPLE 22

3-t-Butyl-4-neopentyl-1,2-dithiolium hydrogen sulfate.

To a sample of 5.2 grams of 4-neopentyl-5-t-butyl 1,2-dithiole-3-thione dissolved in 100 grams of chloroform was added a solution of 12.2 grams of m-chloroperbenzoic acid (85%) in 200 grams of chloroform. The mixture was allowed to stand for 24 hours at room temperature. The chloroform solution was evaporated under diminished pressure and the remaining solid extracted with 100 cc of distilled water. The aqueous solution was distilled under diminished pressure to yield 4.8 grams (73% of theory) of Ex.19.

EXAMPLE 23

4-Phenyl-1,2-dithiolium hydrogen sulfate.

This product was prepared in 80% yield from 4-penyl 1,2-dithiole-3-thione according to the procedure described in Example 22. Bright yellow solid m.p. 230-232°C. (dec.); u.v.λ max. $H_2O$ (E) 242 mμ (15,400) and 345 mμ (1,700), nmr (solvent $D_2O$) in ppm, internal standard t.m.s., -0.06 (*s.*, 2H) and 2.05–2.51 (m., 5H).

Anal. Calced. for $C_9H_8O_4S_3$: C, 39.1; H,2.9; S,34.8 Found: C, 38.8; H,3.1; S,34.9

EXAMPLE 24

3-(p-methoxy phenyl) - 1,2 thiolium hydrogen sulfate.

The desired product was obtained in a 40% yield, according to the procedure described in Example 19, as an orange solid, m.p. 195-196°C. (dec.), after crystallization from ethanol; u.v.λ max. $H_2O$ (E) 244 mμ (7,100) and 411 mμ (23,300).

Anal. Calced. for $C_{10}H_{10}O_5S_3$: C, 39.2; H,3.3; S,31.4 Found: C, 39.1; H,3.1; S,31.2

The formulae of the above dithiolium compounds are presented in the following Table:

TABLE II

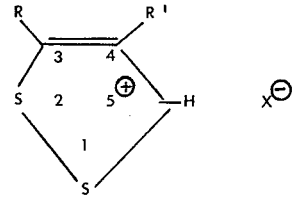

| Ex. | R (3) | R' (4) | X |
|---|---|---|---|
| 19 | $CH_3-C(CH_3)_2-$ | $CH_3-C(CH_3)_2-CH_2-$ | $HSO_4$ |
| 20 | $CH_3-C(CH_3)_2-$ | $CH_3-C(CH_3)_2-CH_2-$ | $ClO_4$ |
| 21 | Same as Example 19 | | |
| 22 | Same as Example 19 | | |
| 23 | H | 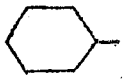 | $HSO_4$ |
| 24 | $CH_3O$- 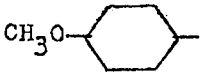 | H | $HSO_4$ |

The reaction may be summarized as follows:

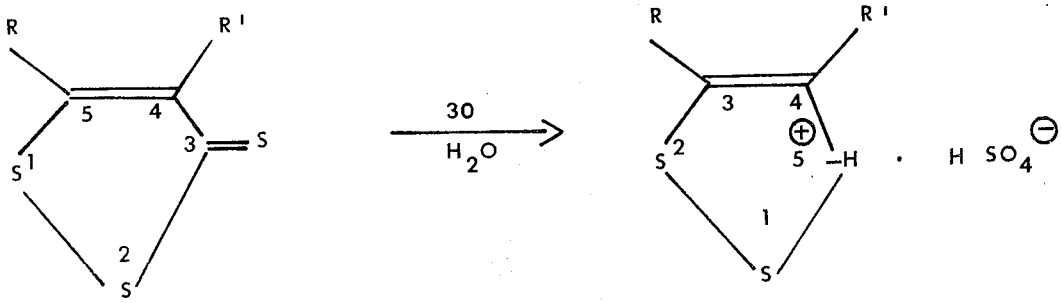

The anion employed will depend on the properties desired for example solubility, insolubility, partial solubility. Example of anions include sulfates, bisulfates, sulfites, bisulfites, halides, i.e. Cl, Br, I, F, etc., phosphates, phosphites, etc., chlorates, etc. In addition to employing the salts, quaternaries can be employed so that the hydrogen in the 5 position R'' is for example alkyl, aryl, etc.

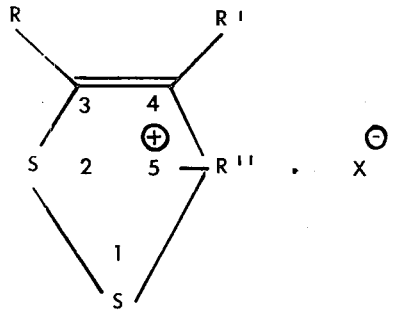

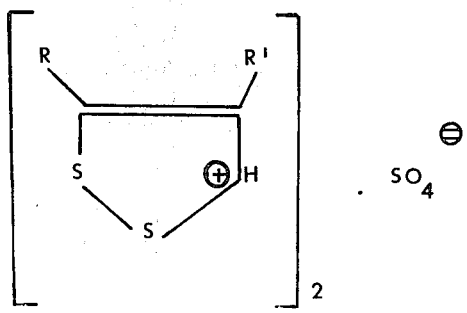

, etc.

Any suitable quaternizing agent may be employed, for example,

1. Alkyl halides such as methyl iodide, butyl iodide, butyl bromide, etc.
2. Sulfuric acid and derivatives $H_2SO_4$, $R_2SO_4$ where R is alkyl, etc., methyl, ethyl, etc. for example $(Me)_2SO_4$
3. Alkyl thioureas such as methyl thiourea, etc.
4. Sulfonate esters, for example

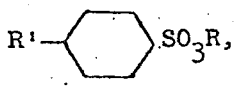

where R is alkyl such as methyl, etc., and R is hydrogen, alkyl, etc. for example, methyl p-toluene sulfonates.

5. Alkyl phosphates, e.g. $(MeO)_3PO$, $(EtO)_3PO$, etc.

It is to be noted where the anion is polyfunctional, such as difunctional, 2 moles of the dithiolium would be coupled with one mole of the anion for example

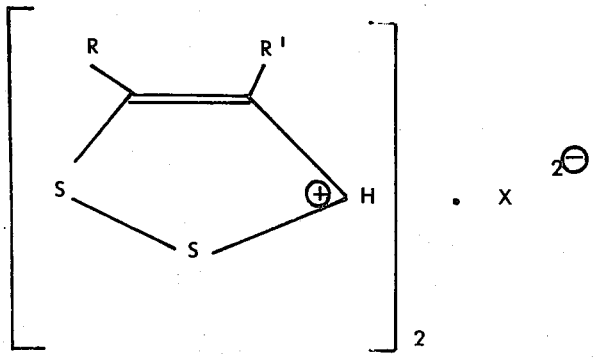

such as where X is sulfate a dicarboxylic acid such as phthalic acid, etc. for example Polyfunctional quaternaries may also be formed for example

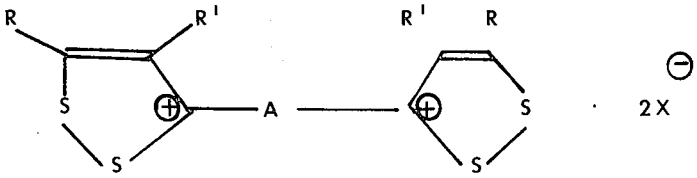

such as where A is alkylene,

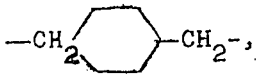

$—(CH_2CH_2)_2O$, $—CH_2—CH{=}CH—CH_2—$, etc.

The yield of the quaternaries (or thionium derivatives of 1,2-dithiole-3-thiones) can be enhanced, by reducing the solvent or preferably in the substantial absence of solvent. For example, by quaternizing in the absence of solvents substantially quantitative yields can be obtained as compared to low yields obtained when prepared in the presence of solvents.

This reaction is carried out at any suitable temperature and time, for example, at about 100 to 300°C., such as from about 140 to 240°C. but preferably from about 160 to 220°C. for a period of about 2 to 160 hours, and about 10 to 50 hours, but preferably about 15 to 40 hours.

The thionium compounds are prepared by reacting the 1,2-dithiole-3-thiones with any suitable quaternizing agent at suitable temperatures and times, such as a temperature of from about 40° to 200°C., but preferably from about 50 to 180°C., for a period of about 1 to 24 hours, such as about 2 to 15 hours, but preferably 3 to 6 hours.

The following examples are presented by way of illustration and not of limitation.

EXAMPLE 25

The Preparation of 4-phenyl-1,2-dithiole-3-thione

In a suitable reactor equipped with a stirrer, thermometer and a reflux condenser, was placed 118 g of methylstyrene and 48 g of sulfur. The mixture was heated for 37 hours at 200-210°C. After the reaction was completed, the mixture was slowly cooled to room temperature. The product was collected and crystallized from benzene, red crystals, (32 grams, 50% yield), m.p. 122-124°C.

METHOD A

Quaternization of 4-phenyl-1,2-dithiole-3-thione in the presence of solvent-isopropanol with $(CH_3)_2SO_4$ A sample of 21.0 g of 4-phenyl-1,2-dithiole-3-thione (Ex. 25) and 12.6 g of dimethylsulfate $(CH_3)_2SO_4$ in 180 cc of isopropanol was refluxed for 24 hours. After this period 4.5 g of the product was removed by decanting the hot isopropanol solution. After the isopropanol cooled to room temperature, crystallization took place. The crystals, 3 g were identified as unreacted starting material. Yield was 64%.

METHOD B

Quaternization of 4-phenyl-1,2-dithiole-3-thione in the presence of solvent-benzene with $(CH_3)_2SO_4$ A sample of 8.4 g of 4-phenyl-1,2-dithiole-3-thione (Ex. 25) and 5.0 g of dimethylsulfate in 100 cc of benzene was refluxed for 24 hours. The product was dissolved in a mixture of 100 cc $H_2O$ and 10 cc of acetone. About 1.0 g of by-product was formed. Yield was 85%.

EXAMPLE 26

Preparation of 4-(3-methoxy-4-hydroxy)phenyl-1,2-dithiole-3-thione

In a suitable reactor equipped with a stirrer, thermometer, addition funnel and reflux condenser was placed, 32 g of sulfur, 1.0 g of di-o-tolylguanidine as catalyst and 150 cc of mesitylene as solvent. The mixture was brought to a reflux (170°C.) and over a 1 hour period 66 g of isoeugenol

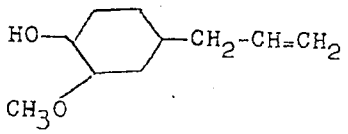

was added dropwise. Reflux was continued for 48 more hours. The mesitylene was decanted from the solid. The solid was treated twice with 500 cc portion of a 5% aqueous potassium hydroxide solution. Upon acidification the product precipitated as a brown solid.

A 5.2 g sample of 5-(3-methoxy-4-hydroxy)phenyl-1,2-dithiole-3-thione was quaternized following Method B, (with benzene as a solvent) the yield was 40%.

METHOD C

Quaternization without solvent with $(CH_3)_2SO_4$

A 17.0 g sample of 5-(3-methoxy-4-hydroxy)phenyl-1,2-dithiole-3-thione and 8.5 g of dimethyl sulfate were heated for 1 hour at 100°–120°C. After the reaction was completed 25.5 g of isopropanol was added to give a homogeneous solution. Yield was quantitative.

EXAMPLE 27

Preparation of 4-neopentyl-5-t-butyl-1,2-dithiole-3-thione

To a mixture of 320 g of sulfur and 6.0 g of di-o-tolylguanidine was added over a 9 hour period, at a reaction temperature of 210-215°C., 336 g of triisobutylene, Mainly

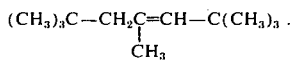

Heating at 210°–215°C. was continued for an additional 14 hours. The product was distilled and there was collected 220 g of 4-neopentyl-5-t-butyl-1,2-dithiole-3-thione, b.p. 155°–185°C. (3-4 mm Hg).

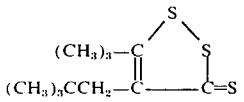

Quaternization according to Method A (with isopropanol as solvent) failed. The use of acetic acid as the solvent in the quaternization was unsuccessful. Method C (without solvent), however, converted 4-neopentyl-5-t-butyl-1,2 dithiole-3-thione quantitatively to its quaternary methosulfate.

METHOD D

Quaternization of 4-neopentyl-5-t-butyl-1,2-dithiole-3-thione with methyl iodide employing chloroform as solvent A sample of 3.0 g of 4-neopentyl-5-t-butyl-1,2 dithiole-3-thione and 6.0 g of methyl iodide in 50 cc of chloroform was allowed to stand overnight. The solvent was removed and the orange solid washed with isopropanol and benzene, m.p. 135-142°C. Yield was 3.8 g (82%).

EXAMPLE 28 Preparation of 4,5-tetramethylene-1,3-dithiole-3-thione

In a suitable reactor equipped with a stirrer, reflux condenser, thermometer and addition funnel was placed 24 g. of sulfur, 171 g of carbon disulfide and 150 cc of dimethyl formamide. The mixture was cooled to 0°C. and under continuous stirring and cooling 132 g. of 1-morpholino-1-cyclohexene was introduced over a ½ hour period. After the addition was completed, stirring was continued for an additional 16 hrs. The resulting slurry was poured into water and the resulting orange solid crystallized from acetone, m.p. 95°–97°C. Yield 37%.

Method A

Quaternization of 4,5-tetramethylene-1,2-dithiole-3-thione in the presence of solvent-isopropanol A sample of 11.3 g of 4,5-tetramethylene-1,3-dithiole-3-thione and 7.6 g of dimethyl sulfate in 100 cc of isopropanol was refluxed for 24 hrs. During this time hydrogen sulfide is evolved. After the reaction was completed 5 g of a hard blue solid crystallized from the solution. The nuclear magnetic resonance spectrum of the product is consistent with the following structure:

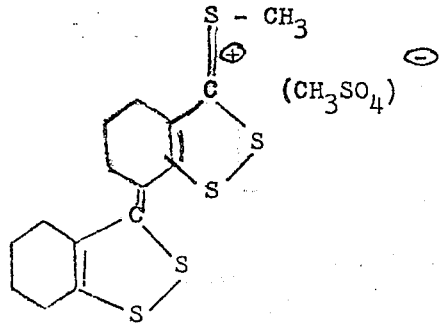

The mother liquor contained 50% of 3-S-methyl-4,5-tetramethylene-1,2-dithiole-3-thione methosulfate.

Tests were carried out according to the following procedures.

I. Inhibition of Stress Corrosion Cracking

All stress corrosion cracking tests were conducted in sealed 2000 c.c. glass resin kettles which were continuously stirred and sparged with the appropriate gas. The use of stressed U-bends is common in this kind of testing with time to failure frequently the reported dependent variable. In Table III data, time-to-fail represent the time for complete failure in the case of the type 4130 steels since cracks here propagate rapidly. Time to failure represents the time for optically visable cracks formation in the case of type 304 stainless steel tests.

The steel, A.I.S.I. type 4130, used in these tests was cut into 4 × ½ × ⅛ inch strips, surface ground, bent into a U shape with parallel legs and a bend radius of 7/16 inch, then pre-notched before heat treatment. Heat treatment consisted of heating in an Argon atmosphere for 1 hour at 1550°F, quenching in ambient temperature 10% brine, and tempering for 1 hour at 750°F. This procedure gave a measured average hardness of Rockwell C 41, corresponding to a tensile strength of roughly 190,000 PSI. The higher strength U-bends were given a 1 hour temper at 600°F producing a Rockwell C 46 hardness. Pre-notching to a depth of ⅓ the U-bend width was done with a sharp hacksaw at a point 45° into the bend. This pre-notching procedure gave an improvement in reproducibility over smooth U-bends. After heat treatment, coupons were cleaned by wire brushing, washing with soap, and rinsing with acetone.

The type 304 stainless steel U-bends had the same configuration but were given no pre-notch. No additional heat treatment was given the as-received alloy so only cleaning was required after bending.

Immediately before immersion, the coupons were stressed just beyond yield by tightening a bolt placed through holes in the legs, using the same deflection in each case. This provided a range of tensile stresses which included effective stresses greater than the yield point. Stressing was done with bolts of like alloy composition so as to give no galvanic contribution to the U-bend alloy. The U-bends were again rinsed in water followed by acetone, then suspended in the test media by Teflon strings. These test conditions are quite severe from a stress corrosion cracking standpoint. That is, the steel used is susceptible, the stresses are high, and test temperatures are in the range where stress corrosion cracking damage is potentially great for the particular system. Any conclusions drawn from these conditions, however, should extrapolate to more practical sets of conditions. In addition, there are advantages to severe laboratory test conditions, namely:

1. Tests are relatively short term. This avoids the problems of corrosion product building in test fluids and metal surface area changes, and provides obvious scheduling advantages.

2. Tests that point out conditions of decreased cracking severeity will be conservative; in field conditions any increases in usable service life will be amplified.

Corrosion rate tests that corresponded to the U-bend tests were made on type 1020 steel and type 304 stainless steel electrodes measured by the PAIR technique. (Comparative tests show that type 1020 and type 4130 steels experience about the same corrosion in $H_2S$ saturated brine and exhibit the same response to inhibitors.) Corrosion rates are tabulated as the rate after a two hour exposure period since this initial period determines to a large extent the life of the U-bend. U-bends which did not fail in long periods were removed, mechanically cleaned, solvent rinsed, and placed in uninhibited fluids; failure in less than two hours was taken as an indication of no abnormalities in metallurgy or stress, so the original test result was recorded and tabulated in Table III.

In the following tests of Tables III, IV and V the following compositions were employed:

THIOPHOSPHATE:

A mixture of $(RO)_2\overset{S}{\overset{\|}{P}}SH$, $RO_2\overset{S}{\overset{\|}{P}}-S-\overset{S}{\overset{\|}{P}}(OR)_2$ and 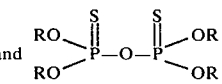

ACYLATED POLYAMINE I:

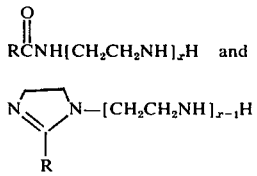

As a tall oil fatty acid - dimeric acid salt.

ACYLATED POLYAMINE II:

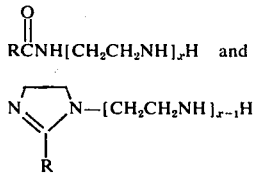

ACYLATED POLYAMINE III:

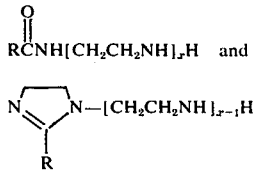

where x has different values

ACYLATED POLYAMINE IV:

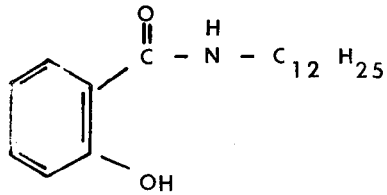

QUATERNIZED TRITHIONE:

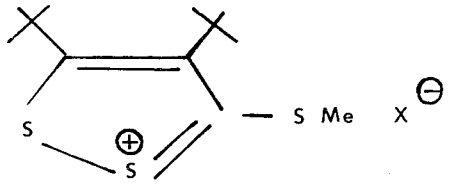

where X = $MeOSO_3$

OXIDIZING INORGANIC INHIBITOR:

$Na_2Cr_2O_7 \cdot 2H_2O$

AMINE SALT:

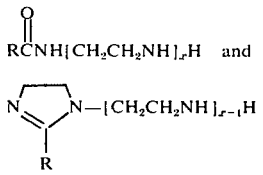

as a water soluble tall oil fatty acid - acetic acid salt

R in all the above formulae is derived from a tall oil fatty acid

Table IV presents data relative to hydrogen penetration. The procedure for such determinations was carried out by the following procedure.

Hydrogen Permeation Probe Tests

These tests involved simultaneous general corrosion measurements and hydrogen penetration data on a common steel surface. Corrosion was measured by linear polarization resistance using the PAIR technique on the outer diameter of the probe, checked periodically with weight loss corrosion coupons. This probe is a hollow tube machined from hot rolled mild steel bar stock. Inside the probe, a potential of +0.250V versus a copper reference electrode (about 0.000V versus SCE in this environment) was held on the inner surface of the steel probe with a McKee Pederson potentiostat; the filling solution was 1% NaOH and the central stainless steel tube was used as the counter electrode - cathode in this case. The entire probe assembly was threaded for insertion into controlled atmosphere containers, stirred 1000 cc phenolic pots, for these tests. This basic technique for measuring hydrogen has been used extensively, only the geometry was changed for presently reported tests. The current required to maintain the polarization, above a low base current, is proportional to hydrogen atom arrival and subsequent anodic oxidation at the inner diameter of the steel. Since the corrosion rate of steel even at slightly anodic potentials is quite low in 1% NaOH, the test is sensitive Table III Inhibiton of Stress Corrosion Cracking U-Bend Tests

| Test | Environment | Saturating Gas | Temperature | Metal | Corrosion rt. mpy | Av. Hrs. to Fail* |
|---|---|---|---|---|---|---|
| 1 | 3.5% NaCl | $H_2S$ | 72°F. | Hardened type 4130 steel | 35 mpy | 1.6 |
| 2 | 3.5% NaCl plus thiophosphate | " | " | " | 5 mpy | 12 |
| 3 | 3.5% NaCl plus oxidizing inorganic inhibitor | " | " | Hardened type 4130 steel | 60 mpy | 0.8 |
| 4 | 3.5% NaCl plus amine salt | " | " | " | 5 mpy | 1.0 |
| 5 | 3.5% NaCl plus thiophosphate plus hydrocarbon | " | " | " | 3 mpy | 36 |
| 6 | 3.5% NaCl plus acylated polyamine I | " | " | " | 2 mpy | 14 |
| 7 | 3.5% NaCl plus thiophosphate plus acylated polyamine I plus quaternized trithione | " | " | " | 2 mpy | 156+ |
| 8 | 3.5% NaCl | $N_2$ | 175°F. | High Strength type 4130 steel | 3 mpy | 6.8 |
| 9 | 3.5% NaCl | Air | " | " | 45 mpy | 52 |
| 10 | 3.5% NaCl plus quaternized trithione | $N_2$ | " | " | 1 mpy | 92+ |
| 11 | 3.5% NaCl pH 1.5 | " | " | " | 1000 mpy | 0.3 |
| 12 | 3.5% NaCl pH 1.5 plus quaternized trithione | $N_2$ | 175°F. | High strength type 4130 steel | 10 mpy | 13+ |
| 13 | 3.5% NaCl pH 1.5 plus oxidizing inorganic inhibitor | " | " | " | 100 mpy | 0.5 |
| 14 | 37% $CaCl_2$ | " | 230°F. | type 304 stainless steel | 0.2 mpy | 20 |
| 15 | 37% $CaCl_2$ plus thiophosphate | " | " | " | 0.02 mpy | 888+ |

*+ superscript indicates "not failed"

to very small quantities of hydrogen. After finish of each test, the probes were cleaned by a short dip in uninhibited 30% HCl, followed by rinsing in water and then acetone. Preliminary polarization inside the probe was established and maintained until the current dropped back to the base level of about 3 amps total current. The outside of the probe was then abraded to a uniform surface with 240 grit silicon carbide paper, given a final wash, and inserted into the next test fluid at the same depth. Test fluids were de-aerated before probe insertion.

Table IV

Hydrogen Penetration in $H_2S$ Saturated 3.5% NaCl at Room Temperature

| Additive | Corrosion Rate mpy | Corrosion Rate % Protection | Hydrogen Current total Ma. | Hydrogen Current % Thru |
|---|---|---|---|---|
| Blank | 58 | — | .234 | 4.0% |
| Dicoco Quaternary | 2.3 | 96% | .069 | 30 % |
| Pyridinium Quaternary | 3.1 | 95% | .059 | 19 % |
| Amine salt | 1.9 | 97% | .041 | 22 % |
| Thiophosphate | 4.9 | 92% | .024 | 4.9% |
| Acylated Polyamine I | 1.2 | 98% | .023 | 19 % |
| Quaternized Trithione | 12 | 80% | .013 | 1.1% |
| Thiophosphate + quaternized Trithione | 1.6 | 98% | .014 | 8.8% |
| Thiophosphate + quaternized trithione + acylated polyamine I | 1.9 | 97% | .012 | 6.3% |
| Mineral Spirits Blank | 49 | — | .117 | 2.4% |
| Mineral Spirits + Amine salt | 1.4 | 97% | .031 | 22 % |
| Mineral Spirits + Thiophosphate | 2.6 | 95% | .015 | 5.8% |
| Mineral Spirits + acylated polyamine I | 0.18 | 99%+ | .010 | 54 % |
| Mineral Spirits + acylated polyamine II | 1.6 | 97% | .012 | 7.5% |
| Mineral Spirits + acylated polyamine III | 0.20 | 99%+ | .013 | 65 G |
| Mineral Spirits + Quaternized trithione | 22 | 56% | .039 | 1.8% |
| Mineral Spirits + thiophosphate + quaternized trithione | 1.2 | 98% | .008 | 6.7% |
| Mineral Spirits + thiophosphate + quaternized trithione + acylated polyamine I | 0.09 | 99%+ | .005 | 56 % |
| Mineral Spirits + thiophosphate + quaternized trithione + acylated polyamine III | 0.15 | 99%+ | .005 | 33 % |
| Mineral Spirits + acylated polyamine IV | .61 | 98% | .009 | 15 % |

Table V

Corrosion Fatigue in Sour Brine-Hydrocarbon at Room Temperature

| Inhibitor | Coupon Life at 25,000 psi |
|---|---|
| None | 760,000 cycles |
| Acylated polyamine I | 10,000,000 cycles |
| Amine salt | 1,050,000 cycles |
| Acylated polyamine IV | 12,000,000 cycles |

Procedure for Data in Table V

These tests were conducted in a sealed monel box which had test fluids circulated through during operation. Four steel specimens were anchored by their bases to the floor of the box while an oscillating yoke arrangement deflected the tops of the coupons back and forth to give alternate tension and compression fiber stresses to the coupons. This test method has been used by Mehdizadeh, et al and data published showing inhibitor effects. Parviz Mehdizadeh, R. L. McGlasson, and J. E. Landers. Corrosion, Vol. 23, p. 65 (1967).

INTERPRETATION OF DATA

In Table III

1. The type 4130 steel U-bends tested in 3.5% NaCl (the first 13 tests) all probably are cracked by a hydrogen penetration mechanism. The presence of $H_2S$ and the lower temperature in the first 7 tests are both severe conditions for this type of cracking. This enables failure in U-bends of lower strenghts (hardnesses). 2. Note the inhibitor additions to $H_2S$ saturated 3.5% NaCl at 72°F; cracking times can vary widely at nearly the same corrosion rate especially in the case of Test 7.

3. In the case of $H_2S$ free 3.5% NaCl at 175°F, quaternized trithione greatly lowers cracking susceptibility (test 10.) Since no air or $H_2S$ are present in this test fluid, the thiophosphate and acylated polyamine are not as necessary, but presumably could be used, especially acylated polyamine.

4. The type 304 stainless steel U-bends probably crack in 230°F, 37% $CaCl_2$ by an active path corrosion mechanism. Thiophosphate is an effective inhibitor in reducing the already low corrosion rate of this system and greatly lowers cracking susceptibility. Again, the 2 or 3 component blends have greater effects and test conditions can be altered to show these greater effects.

In Table IV

1. These data show the amount of hydrogen penetrating from corrosion and that penetration expressed as a percent of the total amount generated (% thru).

2. Again, it can be noted that there is a wide variation in hydrogen throughput at nearly the same corrosion rates.

3. There is a general correlation between short times to failure in the first 7 U-bend tests of Table III and large amounts of hydrogen throughput in Table IV.

4. The presence of mineral spirits emulsified into the brine helps nearly all of the inhibitors in both corrosion and hydrogen penetration reduction.

5. Again, the thiophosphate-quaternized trithione and thiophosphate-quaternized trithione-acylated polyamine blends are best. There is probably little difference in which acylated polyamine is used as far as hydrogen penetration is concerned.

In Table V.

By comparing various acylated polyamines and amine salts results on corrosion fatigue to the data on the same inhibitor in Table IV it can be seen that hydrogen penetration can be used to predict corrosion fatigue performance.

Carbon and alloy steels are recognized to undergo stress corrosion cracking and blistering in numerous environments via some type of surface reaction between the metal and the environment. The mechanism of damage of the austenitic high alloy steels and the ferritic low carbon steels is felt by many investigators to differ from that of hardenable carbon and alloy steels. This latter kind of cracking and blistering is aggravated by the presence of hydrogen sulfide; many, but not all, investigators believe that the mechanism is the same in the presence of sulfide but just more severe.

It is generally felt this first type of cracking, type 304 stainless steel in chloride solutions or low carbon steel in nitrate solutions for example, is due to a mechanism whereby corrosion takes place at an accelerated rate along some active path generated by a tensile stress-metal interaction. The second type of cracking system, high strength low alloy steels in brines or medium strength low alloy steels in $H_2S$ laden fluids for example, is generally thought to only indirectly involve corrosion. As corrosion occurs on the metal surface, hydrogen ions are being discharged at the same time at this surface. These nascent hydrogen atoms have two alternative paths; they can combine to form molecules of hydrogen gas or they can dissolve into the metal lattice. It is then this penetrative hydrogen that causes blistering and cracking damage and sulfide can greatly increase the fraction of nascent hydrogen that dissolves into steel. The action of the tensile stress seems to be to concentrate this hydrogen at certain locations where damage then begins. One approach to minimizing cracking and blistering of ferrous alloys when hydrogen penetration is suspected to be causitive is to simply lower the corrosion rate thus reducing the amount of hydrogen available. The usefulness of this approach has been demonstrated in laboratory and field experiments.

As the tabulated data points out, however, I have seen wide differences in measured hydrogen penetration and stress corrosion cracking in the presence of corrosion inhibitors which give essentially the same corrosion rate. This means that some inhibitors reduce the percent of corrosion generated hydrogen which enters the steel in addition to reducing the total amount of hydrogen. Superimposed on these effects is the experimental fact that lower corrosion rates in general give higher percents of penetrating hydrogen.

Thus, I have discovered a series of inhibitor blends which are effective against stress corrosion cracking and hydrogen penetration of ferrous alloys which are also effective in inhibiting corrosion fatigue. These inhibitors are thiophosphates and trithiones blended in varying ratios with acylated polyamines preferably where the acylating agent contains significant amounts of tall oil acids.

Thiophosphate-trithione-film forming blends are effective in greatly reducing hydrogen penetration and stress corrosion cracking. I have combined the good corrosion inhibiting properties of some of the components with the lowered percent hydrogen entry properties of others, and obtained a result better than any of the components acting alone.

In stress corrosion cracking of other ferrous alloys, such as type 304 stainless steels in chloride solutions, the mechanism is perhaps different but corrosion is definitely involved as a first order effect. This is why some of the blends of this invention are able to minimize or prevent stress corrosion cracking in these systems.

As employed herein and in the claims "corrosion of the stress cracking type" means the following:

1. stress (continuing tensile stress) cracking
2. hydrogen embrittlement or blistering and
3. corrosion fatigue (alternating tensile stress).

I claim:

1. A corrosion inhibiting composition comprising (1) 1,2-dithiole-3-thiones or quaternaries thereof and (2) thiophosphates containing both oxygen and sulfur, pyrophosphates containing both oxygen and sulfur, or mixtures thereof.

2. The composition of claim 1 which also contains a film-forming corrosion inhibitor.

3. The composition of claim 2 where the film-forming corrosion inhibitor is a nitrogen base.

4. The composition of claim 3 where the film-forming corrosion inhibitor is an acylated polyamine.

5. A process of inhibiting corrosion of the stress cracking type which comprises treating a system with the composition of claim 1.

6. A process of inhibiting corrosion of the stress cracking type which comprises treating a system with the composition of claim 2.

7. A process of inhibiting corrosion of the stress cracking type which comprises treating a system with the composition of claim 3.

8. A process of inhibiting corrosion of the stress cracking type which comprises treating a system with the composition of claim 4.

* * * * *

UNITED STATES PATENT OFFICE
CERTIFICATE OF CORRECTION

Patent No. 3,959,177 Dated May 25, 1976

Inventor(s) Richard L. Martin

It is certified that error appears in the above-identified patent and that said Letters Patent are hereby corrected as shown below:

In col. 12, line 41, "5-5-butyl" should read

--- 5-t-butyl ---

In col. 12, lines 45 to 49, the formula

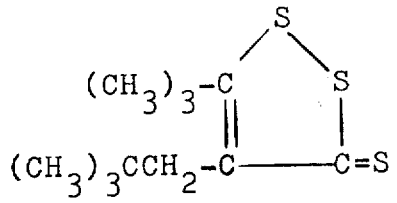

should read

---

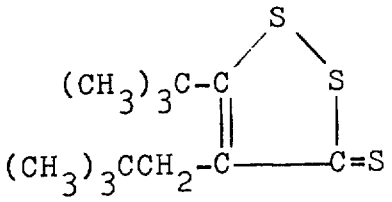

---

UNITED STATES PATENT OFFICE
CERTIFICATE OF CORRECTION

Patent No. 3,959,177 Dated May 25, 1976

Inventor(s) Richard L. Martin

It is certified that error appears in the above-identified patent and that said Letters Patent are hereby corrected as shown below:

In col. 24, lines 6 through 10, the formula

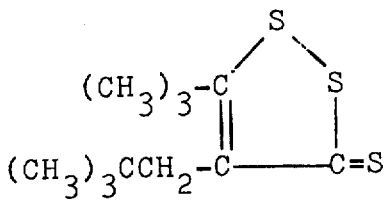

should read

---

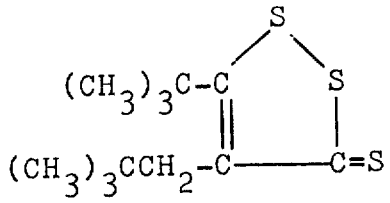

---

UNITED STATES PATENT OFFICE

CERTIFICATE OF CORRECTION

Patent No. 3,959,177 Dated May 25, 1976

Inventor(s) Richard L. Martin

It is certified that error appears in the above-identified patent and that said Letters Patent are hereby corrected as shown below:

In col. 27, lines 2 through 10, the formula

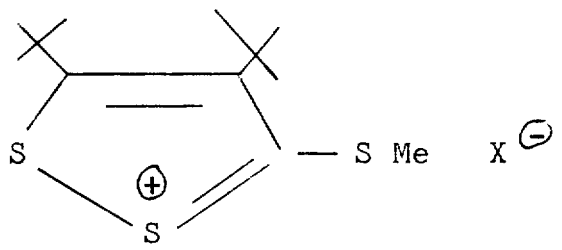

should read:

--- 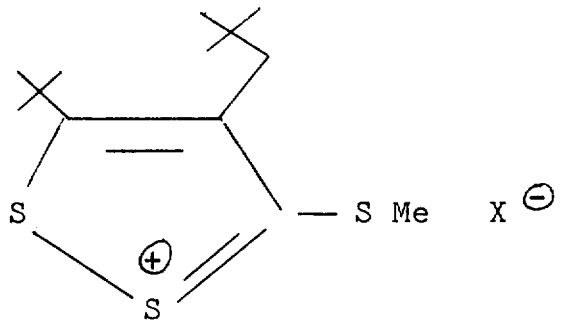

---

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*